US005404135A

United States Patent [19]

Janex

[11] Patent Number: 5,404,135

[45] Date of Patent: Apr. 4, 1995

[54] SEA NAVIGATION CONTROL PROCESS

[75] Inventor: Albert Janex, Cachan, France

[73] Assignee: Thomson-CSF, Puteaux, France

[21] Appl. No.: 37,565

[22] Filed: Mar. 26, 1993

[30] Foreign Application Priority Data

Mar. 27, 1992 [FR] France ..... 92 03714

[51] Int. Cl.[6] ..... G08G 1/123

[52] U.S. Cl. ..... 340/988; 340/961; 340/984; 342/455; 364/461

[58] Field of Search ..... 340/961, 988, 989, 990, 340/984, 905, 992; 342/457, 357, 41, 455; 364/461, 449, 439; 455/54.1, 53.1, 54.2, 58.1

[56] References Cited

U.S. PATENT DOCUMENTS

| | | | |
|---|---|---|---|
| 3,643,259 | 2/1972 | Enther | 342/357 |
| 3,646,580 | 2/1972 | Fuller et al. | 340/989 |
| 3,757,339 | 9/1973 | Shear et al. | 340/961 |
| 4,232,313 | 11/1980 | Fleishman | 364/460 |
| 4,706,090 | 11/1987 | Hashiguchi et al. | 342/41 |
| 4,788,543 | 11/1988 | Rubin | 455/58.1 |
| 4,835,537 | 5/1989 | Manion | 340/961 |
| 5,068,654 | 11/1991 | Husher | 340/988 |
| 5,101,502 | 3/1992 | Felderman et al. | 455/58.1 |
| 5,225,843 | 7/1993 | Thompson | 342/357 |

FOREIGN PATENT DOCUMENTS

| | | |
|---|---|---|
| 0379198 | 7/1990 | European Pat. Off. . |
| 2420799 | 10/1979 | France . |
| 2601168 | 1/1988 | France . |
| 2661536 | 10/1991 | France . |
| 1310679 | 3/1973 | United Kingdom . |

OTHER PUBLICATIONS

RTCA Paper No. 376-92/SC159-368, Apr. 1992 pp. 1-11, "An Introduction to the GP & C Satellite Navigation User System".

*Primary Examiner*—Brent Swarthout

*Attorney, Agent, or Firm*—Oblon, Spivak, McClelland, Maier & Neustadt

[57] ABSTRACT

A system for sea navigation which features a plurality of ships located in a single high density area (for example port) and a control center for this area using a common transmission channel. The ships are equipped to transmit data about their speed, heading and position, which are displayed on a panoramic screen fitted on all ships and in the control center. The control center has priority access to this common channel to send general interest messages or special messages to all or some of the equipped ships.

10 Claims, 2 Drawing Sheets

SEA NAVIGATION CONTROL PROCESS

BACKGROUND OF THE INVENTION

1) Field of Invention

The present invention concerns a method of control over sea navigation.

2) Description of Prior Act

Despite all detection and control methods available at the present time, the safety of sea traffic in high traffic density zones, particularly coastal and port zones, is not always guaranteed.

In order to guarantee safety, it is important to set up a secure communication system firstly between ships located in the same zone, and secondly between these ships and a maritime traffic control center monitoring this zone.

At the present time there are various methods of communication between vehicles and/or for pinpointing vehicles.

For land traffic, radiotelephone communications are used with coded destination addressing, but this type of system does not enable the user to pinpoint his correspondent.

More complexed equipment (such as GEOSTAR/-LOCSTAR) can be used for communications and for pinpointing; a central station communicates with a mobile station through two circuits each passing through a satellite. The forward-return time necessary for exchanging communications can be used to determine distances from the mobile to the two satellites, and therefore to pinpoint it. This system combines addressing and pinpointing but uses only satellite communications and demands long range communication links.

For air traffic, secondary radar, particularly in S mode, can be used to communicate with an aircraft and simultaneously gives the position and identity. Like the GEOSTAR/LOCSTAR system, this radar combines addressing and pinpointing. Radar is badly adapted to the acquisition of addresses in a dense medium and requires complicated traffic management.

The ADS (Automatic Dependence Surveillance) concept was introduced more recently, and can determine the position and identity of an aircraft (which itself transmits the necessary information) and communicate with it. This system is efficient, but it does not enable participants to communicate between themselves without passing through the control center.

Concerning ships, the only communication method used worldwide at the present time is radiocommunication, generally in VHF, without addressing. Communications are set up on a predefined frequency, or channel, for each geographic area. These methods do not enable the user to correspond with a specific correspondent.

Satellite communications (such as INMARSAT) are starting to be used, and their coverage is almost worldwide due to the number and position of usable satellites. Links are set up by sending a destination address code.

French patents 2 601 168 and 2 661 536 use a system enabling ships to mutually locate each other, particularly in a dense environment (port zone, . . . ) and to safely and unambiguously communicate between themselves using addresses in order to prevent collisions. However, these systems do not enable a control center, for example a port control center, to start a communication with one or several specific ships, or with all ships located in its surveillance area.

SUMMARY OF THE INVENTION

An object of present invention is to provide a sea navigation control system for reducing risks of collision while allowing a control center to supervise all traffic within its surveillance area and thus to further reduce risks of collision.

The control method according to the invention, by which each ship using it repetitively transmits messages containing data about its absolute geographic position, its heading and its speed to all ships concerned on a common channel, together with an arbitrary identification code acting as an address for message exchanges, and receives similar information from surrounding ships that it displays by symbols on a panoramic type screen, wherein the control is supervised by a control center equipped with communication resources using the common channel, which displays all information that it receives from all ships concerned within its surveillance zone on a screen, with all obstacles located in it, and has priority access to this common channel to address all or some of the ships concerned. According to one feature of the invention, in order that the common channel can be used optimally, the period at which messages are transmitted by ships is related to the dynamics of the ambient situation and, for each ship, is a function of at least one of the following criteria: its own speed, the speed of its neighbors, the distance from its neighbors, its own and its neighbors maneuverability, the time to be covered by this ship before reaching its closest point to a neighboring ship.

Further objects and advantages of the present invention will be apparent from the following description of a preferred embodiment as illustrated in the accompanying drawings.

DETAILED DESCRIPTION OF THE PREFERRED EMBODIMENT

Figure 1:
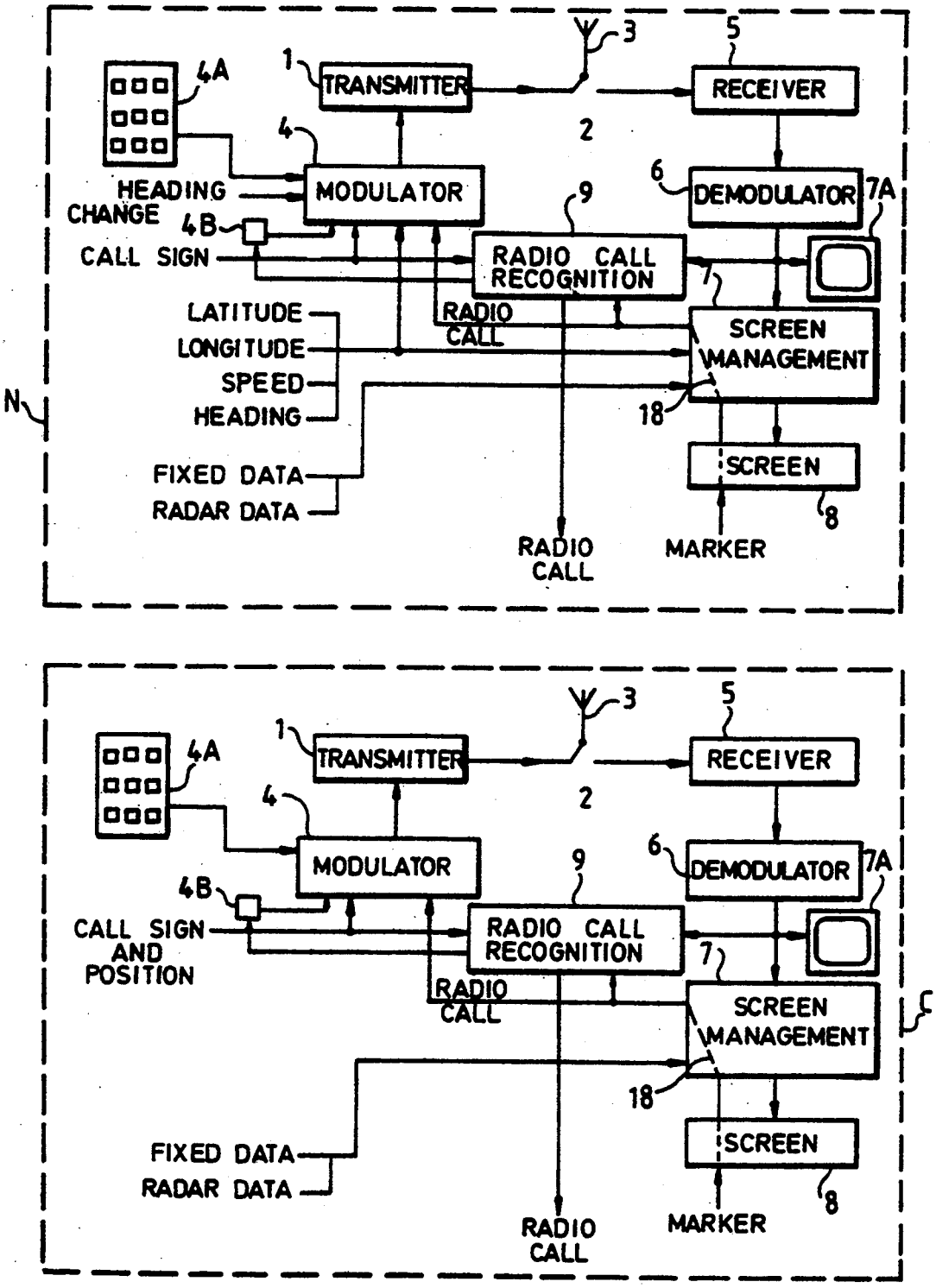
FIG. 1 is a block diagram of a device fitted on each ship, and a device fitted in the control center to implement the process of the invention.

Each ship participating in the anti-collision system in the invention is equipped with a device such as that shown schematically on N on FIG. 1, and will be referred to throughout the following description as the "equipped ship".

Device N shown in FIG. 1 includes a transmitter 1 discontinuously transmitting messages at a very low average load factor (defined as a ratio between the transmission time and non-transmission time), of the order of $10^{-4}$ to $10^{-5}$. The transmission power and frequency are chosen so as to limit the transmitter range to 1 to a few tens of kilometers. The limitation may be due to the curvature of the earth if a transmission frequency is chosen for which propagation is done by direct line of sight, for example a frequency in the UHF band (several tens of MHz) or higher, but without exceeding the X band so that propagation remains practically insensitive to meteorological conditions. The device comprising elements 1, 4, 5 and 6 may also be a VHF transmitter-receiver ordinarily used on ships, together with an appropriate modem. However in this case the load factor will be a little higher due to the low throughput of available modems. The transmitter frequency $F_o$ is the same for all transmitters and receivers in the system.

Transmitter 1 is connected through a switch 2 to an antenna 3 designed for omnidirectional transmission in the horizontal plane.

Transmitter 1 is also connected to a modulator 4. This modulator 4 generates a binary "word" containing all information to be transmitted and transposes it into a signal modulating the transmitter 1. The modulation shape is of the pulse type so as to enable the total lack of transmission outside the time during which the message is transmitted. However the invention method does not impose the type of information modulation; each binary element may be coded using any known coding technique, for example such as pulse position coding, or coding by phase shift (PSK).

The transmitted message contains the following information:

—the ship's coordinates, preferably in latitude and longitude, for example each coded on twenty two binary elements. These coordinates are provided by the ship's radio navigation system. Ships are generally equipped with radionavigation equipment permanently, precisely and reliably giving their absolute geographic position. The precision required by the anti-collision process in the invention is of the order of 100 meters. For example, the radionavigation system known under the "GPS" name satisfies these conditions:

—the ship's speed and heading, this information is generally available on all ships, at least in analogue form, which simply has to be converted into digital form. This information may be coded with sufficient precision by 6 and 8 binary elements respectively;

—possibly (if the standard requires it), the heading change, coded on 2 binary elements; turn to port or turn to starboard. This information may be provided automatically by any known rotation direction readout device, activated at the start of the maneuver. The standard may also contain enriched anticipated information containing more than the heading change alone, particularly the value of the future heading but this would require that it be manually input (by keyboard), and there are risks that the operator would forget to input it.

—A call sign or identification code is described further in more detail below.

It is beneficial if this information is preceded, using a conventional technique in message transmission, by a preamble for initializing some receiver circuits. It is also beneficial if this information is complemented by binary elements forming an end of message symbol, and if it is considered that permanent repetition of messages is not sufficient to eliminate all errors, binary error correction elements may be added (for example binary parity elements).

As mentioned above, if the ship is equipped with a GPS type radionavigation receiver, this receiver could supply most information mentioned above with a precision very much better than that necessary for the system in the invention. In this case, for each item of information we could neglect the superfluous lowest order binary elements and keep only those which are considered to be significant and provide the necessary and sufficient precision to implement the method in the invention as described above. Thus the length of the transmitted message is about at least 100 binary elements. If the passband assigned to the system is of the order of several megahertz, the message will be transmitted in several tens of microseconds.

If each equipped ship transmits such a message at a period of about one second, the traffic load induced on the system by a ship is between $10^{-4}$ and $10^{-5}$. For example, if a hundred ships are simultaneously present in a single geographic area (such as a port), the traffic load on the system is only $10^{-2}$ to $10^{-3}$ which guarantees a good probability that messages will not be mutually scrambled. Note also that this is a relatively severe case, since orders of magnitudes of maneuvering time for ships to avoid collision are measured in minutes, and the message repetition period could be significantly increased thus reducing the probability of mutual scrambling. In particular, these comments make it possible to consider the use of a standard VHF channel and its associated modem as a communication channel. Separations between channels are usually 25 or 50 KHz, which severely reduces the transmission speed compared with the rates mentioned above. The duration of a message will then be measured in tens of milliseconds. About 100 ships simultaneously present would result in a 10% load if the average period was 10 seconds, or 1.7% if the period was increased to 1 minute. These values remain acceptable to give a satisfactory probability of non-collision between messages, particularly when taking account of the adaptations proposed below.

It will be beneficial to randomize the time at which each message is transmitted, such that mutual scrambling remains possible, due to the fact that transmissions from the various ships are not synchronized. Thus for the first example mentioned above for a repetition period of one second, this value would only be a mean statistical value and the actual value would have a wide dispersion. The result is that any scrambled message received from a given ship would not be scrambled repeatedly. Also, the high redundancy of messages sent (for a period of about 1 second, any one message will be repeated several times before a significant change in the heading and/or speed and/or geographic position) will mean that the received scrambled message can be ignored.

In order to better adapt the device in the invention to zones with high ship density and/or to use less efficient standard equipment (VHF transmitter-receiver with modem as described above), the number of messages transmitted by some participants may be reduced. This can be done by relating the transmission period of their messages to the dynamics of the surrounding situation. Thus a slow and/or isolated ship could transmit less frequently than the average, whereas a ship that is moving faster and/or is close to other ships would transmit more frequently. Parameters determining the message transmission repetition frequency are, for each ship, its speed, the speed of its neighbors, their distance from the ship in question, and possibly the maneuverability of these ships. These parameters may be combined into a single parameter which is the theoretical time that the ship in question would take to reach the closest point to its neighboring ship if it does not change its heading or its speed. The period at which messages are transmitted may thus vary as a function of these parameters from a few seconds to a few minutes.

Message transmission instants are preferably at random, in order to avoid the use of a complex call management system. Since the throughput through the single common channel in the system is limited, the invention optimizes its use by means of a "slotted Aloha" type technique, and for example uses synchronization signals obtained from signals captured by GPS receivers and transmitted by a pinpointing satellite, in order to synchronize the entire network. Since recovery of synchronization signals is a technique well known on land, it will not be described here. Starting from these synchronization signals, time is broken down into equal basic periods with a duration slightly longer than the message duration, possibly increased by the propagation time for the maximum system range. Each participant places each of its messages within a period selected at random. This thus reduces the risk of collision between messages transmitted by different ships; either they are located in different periods, or they fully overlap. In the latter case they will be incomprehensible and will be ignored, and since the next repetition of each will be also at random, the probability of a new overlap is extremely low.

Another simpler possibility of collecting synchronization could be as follows: any ship may be considered as being either within the radioelectric range of another participant or a control center, or outside its range. In order to determine this, before its first transmission, a ship should listen for a time at least equal to the time defined as the longest period in the system. If it receives nothing during this time, it knows it is isolated and starts to transmit on the lowest recurrence (in accordance with what is acceptable based on the criteria defining intervals without synchronization). Its period may then change when the environment changes (arrival of participants within radioelectric range). It remains without synchronization as long as received messages are from ships and not from a control center. Synchronization is only useful in very dense zones, generally justifying the presence of a control center.

If some received messages are transmitted from a control center, their origin will be used as synchronization in order to initiate a "slotted Aloha" type procedure. This synchronization is approximate but is acceptable here since propagation times are low compared with the message duration. If an absolute synchronization becomes necessary, it could easily be done. Each participant would simply need to correct the above coarse synchronization by the propagation time between the control center and itself. This time can be calculated from the known geographic positions of the 2 partners.

Outside the short transmission times from transmitter 1, inverter 2 connects antenna 3 to a receiver 5 tuned to the system common frequency. Receiver 5 is connected to a data demodulator 6 extracting information from the received signal, carrying out the reverse operations to those carried out in the modulator 4. This modulator is also connected to a data input device 4A such as a keyboard.

Demodulator 6 is connected through a screen management device 7 to a display screen 8. For example, elements 7 and 8 could be a microcomputer and its display monitor. These elements 7 and 8 may be used together with a device 7A to display the identification code of one or several surrounding ships.

Figure 2:
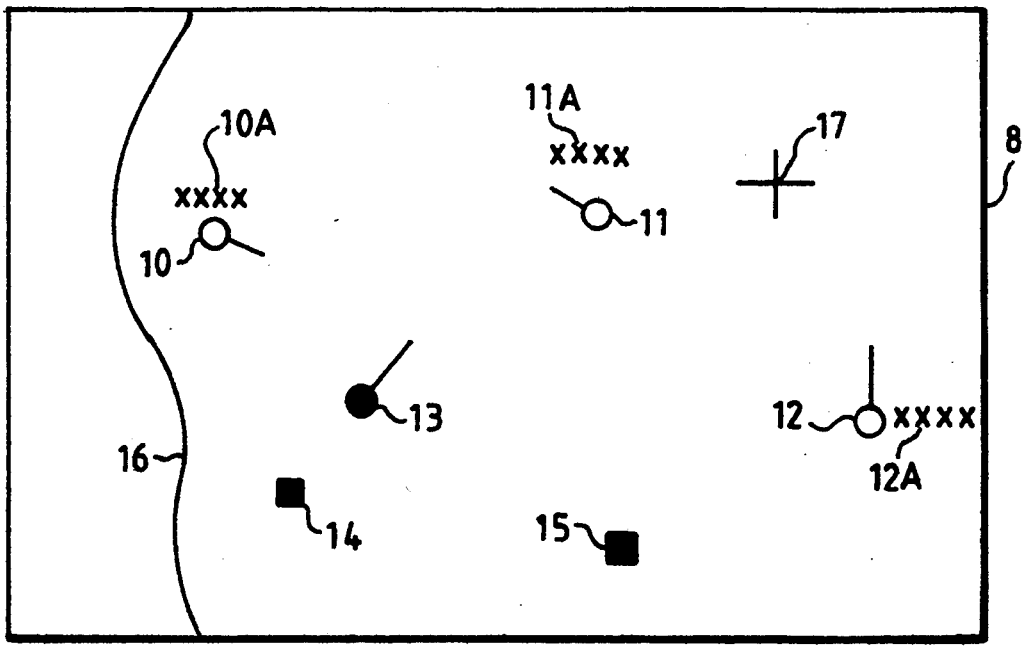
FIG. 2 is a plan view showing an example of the device display screen in FIG. 1.

The purpose of screen 8 is to present an operator with the entire environment of his ship by using information received from surrounding equipped ships, and information received from his own equipment. FIG. 2 shows a non-restrictive example of information that could be displayed on screen 8. This information could be displayed in a form similar to that on a panoramic radar screen.

According to the example in FIG. 2, screen 8 displays the various ships (for example 10, 11 and 12) as large light spots, with his own ship (reference 13) being of a different color and/or shape and/or brightness from those of the other ships. For example, different shapes and/or colors of spots may correspond to different types of ships. Each spot representing a ship is extended by a segment or a straight line representing the corresponding ship's speed vector. The length of this vector is proportional to the speed of the ship, and its orientation defines the heading of this ship. It would also be beneficial to represent information about the heading change close to the speed vector by a different color point or line, either at the left or right depending on the direction change. The general presentation of screen 8 may be made with the North at the top of the screen, but it would also be beneficial to have the top of the screen aligned with the prow of the ship, such that the line of travel of this ship is then fixed. The speed vector of each ship may be an absolute speed, or according to an alternative, a speed relative to the speed of the ship 13 (whose own speed vector will then be zero), the various relative speed vectors of the other ships then being determined by vector composition of their own speed and the speed of ship 13. The point showing the ship 13 may be located at the center of the screen or may be off centered in a direction opposite to its own speed vector in order to give priority to a "forward view".

It would be beneficial to display the identification code (10A, 11A and 12A) close to the point representing each other ship (10, 11 and 12 respectively on FIG. 2).

It would also be beneficial for each equipped ship to contain a radar enabling it to detect surrounding non-equipped ships or with non-functioning equipment, and fixed obstacles (rocks, coastline, etc.). FIG. 2 shows two echoes 14 and 15 each representing non-equipped ships and a coastline 16. Echoes 14 and 15 will preferably be displayed in a shape and/or color different from those of points 10 to 13 so that the operator can immediately realize that they show non-equipped ships or ships with non-functioning equipment, and the absence of the corresponding speed vector does not mean that the speed of this ship is zero.

All transformed coordinates, vectors and possibly information obtained from the onboard radar, are done by the control device 7, by a known method, the construction of which will be well understood by those skilled in the art when reading this description.

Moreover, fixed data stored in a mass memory can also be supplied to the control device 7. The screen may also display cartographic data such as coasts, buoys, lighthouses, etc.

According to a beneficial alternative of the invention, ship equipment also contains a radio call recognition circuit 9 connected firstly to the demodulator output 6, and secondly to a data input keyboard (not shown but the function of which could be carried out by 4A), on which the operator enters the call sign (which is usefully an identification code such as that described below) of the ship with which he wishes to enter into contact, this call sign being immediately sent to demodulator 4 and built into the message periodically transmitted by transmitter 1. Circuit 9 may be a simple comparator in the called ship, comparing the call sign received from the calling ship with its own call sign, and initiating an audible and/or visual alarm when finding that they are equal. Obviously the message received by the called ship contains the calling ship's call sign, which may be displayed on screen 8 on the called ship. For example it could be displayed in plain text (alphanumeric call sign) in a corner of the screen. According to one beneficial alternative, a symbol would appear close to the point representing the calling ship (such as one of the points 10 to 12) instead of or in addition to this display, or the point itself may be modified; for example the symbol could be a circle surrounding the point representing the calling ship, and/or this point could flash or be displayed highlighted.

According to another alternative of the invention, the screen management device 7 may be combined with a "mouse" type device commonly used with microcomputers, this device producing a mobile marker 17 on screen 8, for example in the shape of a cross. When this marker is superimposed on a symbol representing a ship that the operator wants to call by radio, the operator presses or "clicks" the "mouse" start button. This command is processed by device 7 which generates the corresponding call sign (symbolized by the broken line 18) and sends it to modulator 4. In producing this call sign, device 7 stores call signs received from all neighboring ships (displayed on screen 8), sets up a relation between the point on which the marker 17 stopped and the corresponding call sign, and sends this call sign. These functions controlled by device 7 are easy to implement for the expert, and will not be described in more detail. Obviously the "mouse" may be used to acknowledge the call in the called ship, and possibly to open a radio link. The use of the "mouse" prevents possible errors in the two ships (caller and called ships) due to inputting a wrong call sign on the keyboard.

A ship operator may use the mouse or the 4A keyboard to input and/or modify the "identification code" of his own ship.

This identification code may be arbitrary. It does not need to be taken from a lexicon, and cannot be used to genuinely identify its user. This code is a binary number without any meaning other than as an address in the exchange of messages as described in detail below.

However it will be useful if it is standardized as follows:

—some of the binary elements in this number could be assigned to identification of the ship type. This information is useful for coordination of maneuvers of ships close to each other.

—one of the binary elements of the number could be used to indicate if the code is taken from a lexicon (some ships may wish to identify themselves, or in any case not have any reason to hide their identity) or if it has no specific meaning.

—the rest of the code, if it is not taken from a lexicon, contains enough binary elements such that the probability of accidentally using two identical codes within the same zone is negligible, for example about 16 binary elements.

—According to a first alternative, the choice of the rest of the code would be left to the user. However this solution may have disadvantages; mischievous use of another user's code and a more frequent use of some simplified codes increasing the risks that two codes would be identical in the same geographic area.

—According to a second beneficial alternative, the rest of the code would be chosen independently by a processor 4B, connected to modulator 4 and circuit 9. This processor 4B could generate a pseudo-random sequence when it is started up.

—If the user wants to avoid permanent identification, the processor 4B could periodically change the pseudo-random sequence. The processor could make this change during a period of inactivity (absence of any reception during a large number of successive periods).

—Obviously, if processor 4B detects accidental use by another user (detection through circuit 9) of the code sent by its transmitter 1, it could immediately change its own code, or at least the pseudo-random sequence that it generates.

When a communication has been set up between two ships, and each has received the message from the other described in detail with reference to FIG. 2 and used to display the corresponding data on screen 8, these ships can exchange other message types, beneficially replacing a phone link. These other types of messages may in particular concern maneuvering intentions of these two ships. In order to reduce congestion on the transmission channel and to facilitate understanding of these messages, they are coded using a lexicon containing the list of commonly used messages (words and/or phrases) for all possible maneuver types such as: intention to maintain heading, to turn to port or to starboard, waiting for tug, broken down, etc. . . Obviously each ship operator has a translation of the lexicon in his own language. A code can also be provided for a "request for phone transmission" in the relatively unlikely case that one or more of the operators wish to transmit a message not appearing in the lexicon. The frequency to be used for this phone link could also be stated. Obviously, three or more ships may participate in this exchange of coded messages at the same time; due to their short length (for example only 8 binary elements are necessary to code 256 different messages) there is little risk of simultaneous transmission by several ships. Messages may be repeated several times at random intervals in order to reduce the risks of simultaneous transmissions.

Codes for coded messages may be displayed on the monitor 7A or screen 8. According to one beneficial alternative, the translation of these codes is displayed in plain text using a character generator, the manufacture of which is straightforward for an expert. Similarly in order to avoid the need to browse through a lexicon, the keyboard 4A could be replaced by a display device, for example a pulldown menu or icon type screen showing all available messages grouped in types. A pointing device, such as a "mouse", could be used to select the required message and to immediately send the corresponding code.

Device C also shown on FIG. 1 is used in the control center. This device C is similar to devices N used on ships, with the main difference that it does not receive information about its own latitude, longitude, speed and heading/heading change, since it is fixed. However, its fixed position must be transmitted. Obviously its screen 7A may be larger and have a better resolution than that used on ships, since it must be able to display all symbols corresponding to the ships and its surveillance zone. It may also be equipped with several screens each displaying part of its surveillance zone. Finally, antenna 3 on device C may be an antenna with a high vertical directivity in order to generate a fiat beam on the horizon, and in azimuth in order to avoid transmitting towards land.

The control center displays the same type of information as the ships on its own screen 8, using the information transmitted by them. Obviously since this center is fixed, its own coordinates and the orientation of the image displayed on the screen are fixed. The symbol representing it is displayed on the screen as a function of the layout of the displayed zone. Obviously the speed vector of each ship displayed on its screen can only be the absolute speed.

Messages transmitted by the control center may be addressed to all ships that it is monitoring, or to some of them or to only one of them. It will preferably have priority access to the common channel. For example, messages that it sends, or the first message in a series, will thus contain a preamble of several bits. This preamble may indicate the nature of the information that follows: either a "conventional" message similar to messages sent by ships, or a general interest message. In the first case the information may contain the center identification, the identification of one or several selected ships to be contacted, and orders or questions to be sent to them, possibly extracted from a lexicon as described above.

In the second case, transmitted information may for example be the distribution of a map, weather information, information about port activities . . . In most cases these general interest messages may be very much longer than "conventional" messages, and their period may be very low.

In order to reduce risks of overlapping between long general interest messages and conventional ship messages, the invention assigns longer transmission capabilities to general interest messages.

According to a first method of construction, general interest messages are preceded by one or several special "conventional" messages indicating that a general interest message will be broadcast for a given time period starting from a given time. For example, this information may be taken from a lexicon available to all ships. It would be beneficial for the time interval to be a multiple of the "slotted Aloha" base period. All ships must stop transmitting during this period. This process may be automated by integrating a detection circuit into ship demodulators to detect these special conventional messages and to decode the duration of the general interest messages, and the detection circuit may disable its transmitter or prevent the reversing switch from being put into the transmitter position during this period.

According to another method of making the invention, one "slotted Aloha" period out of n is reserved for the central station, and all other ships maintain silence during this period. Ships from outside the zone covered by the control center gradually synchronize with the "slotted Aloha" and remain in the network listening position until they recognize the period reserved for the control center. For example, in order to facilitate this recognition, the control center could transmit a special code during these reserved periods when it does not have any messages to transmit.

When the network uses a lexicon, one of the messages in this lexicon could mean that the transmitting ship wants to change to voice communication on a predefined frequency, or on a frequency coded in this message. Infrequent and short voice communications may be set up using only one transmitter-receiver, normally used for transmitting the messages described above, and temporarily busy for voice communications.

What is claimed is:

1. A sea navigation control system for a plurality of equipped ships comprising:

a transmitter on each equipped ship for transmitting messages on a common channel to other equipped ships, the messages comprising data on each respective equipped ship of an absolute geographic position, heading and speed, and an arbitrary identification code used as an address for message exchanges;

a receiver on each equipped ship for receiving the messages transmitted from surrounding equipped ships, and for displaying information from the received messages as symbols on a panoramic screen;

a control center equipped with communication resources using the common channel, and displaying all messages transmitted from all equipped ships located in a predetermined surveillance area, together with obstacles located in the predetermined surveillance area, on a screen, and having priority access to the common channel to address all or some of the equipped ships, wherein time on the common channel is broken down into equal base periods synchronized by a synchronization signal received by all equipped ships, and which is slightly longer than a duration of the messages transmitted by the equipped ships, and wherein before transmitting messages of general interest, the control center transmits at least one special message indicating that starting from a given moment and during a defined time, the control center will transmit messages of general interest.

2. The system according to claim 1, further comprising a pinpointing satellite for transmitting the synchronization signal.

3. The system according to claim 1, wherein the control center transmits messages of general interest during a multiple of a base period.

4. The system according to claim 1, wherein one of the base periods is regularly reserved for the control center.

5. The system according to claim 1, wherein a transmission period of the messages transmitted by each equipped ship is a function of at least one of the following criteria: a speed of the equipped ship, a speed of other equipped ships, a distance to the other equipped ships, a maneuverability of any of the equipped ships, and a time until the equipped ship reaches a closest point to another of the equipped ships.

6. A sea navigation control method for use with a plurality of equipped ships comprising the steps of:

transmitting by each equipped ship messages on a common channel, the messages comprising data on each respective equipped ship of an absolute geographic position, heading and speed, and an arbitrary identification code used as an address for message exchanges;

receiving by each equipped ship the messages transmitted from surrounding equipped ships, information from the received messages being displayed as symbols on a panoramic screen;

supervising by a control center equipped with communication resources the transmitted messages using the common channel, and the control center displaying all messages transmitted from all ships located in a predetermined surveillance area, together with obstacles located in the predetermined surveillance area, on a screen, and having a priority access to the common channel to address all or some of the equipped ships, wherein time on the common channel is broken down into equal base periods synchronized by a synchronization signal received by all equipped ships, and which is slightly longer than a duration of the messages transmitted by each equipped ship, wherein before transmitting messages of general interest, the control center transmits at least one special message indicating that starting from a given moment and during a defined time, the control center will transmit messages of general interest.

7. The method according to claim 6, wherein the synchronization signal is obtained from signals transmitted by a pinpointing satellite.

8. The method according to claim 6, wherein the control center transmits messages of general interest during a multiple of a base period.

9. The method according to claim 6, wherein one of the base periods is regularly reserved for the control center.

10. The method according to claim 6, wherein a transmission period of each equipped ship is a function of at least one of the following criteria: a speed of the equipped ship, a speed of other equipped ships, a distance to other equipped ships, a maneuverability of any of the equipped ships, and a time until the equipped ship reaches a closest point to another of the equipped ships.

* * * * *